US011436979B2

(12) United States Patent
Kim et al.

(10) Patent No.: US 11,436,979 B2
(45) Date of Patent: Sep. 6, 2022

(54) PIXEL CIRCUIT IN WHICH A DRIVING TRANSISTOR IS ALLOWED TO BE ON-BIASED TO PREVENT UNINTENDED EMISSION

(71) Applicant: Samsung Display Co., Ltd., Yongin-si (KR)

(72) Inventors: Sung Hwan Kim, Yongin-si (KR); Sang Moo Choi, Yongin-si (KR); Dae Hyun Kim, Yongin-si (KR); Soo Hee Oh, Yongin-si (KR); Dong Sun Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 259 days.

(21) Appl. No.: 16/505,708

(22) Filed: Jul. 9, 2019

(65) Prior Publication Data

US 2020/0066212 A1 Feb. 27, 2020

(30) Foreign Application Priority Data

Aug. 23, 2018 (KR) ..... 10-2018-0098582

(51) Int. Cl.
*G09G 3/3266* (2016.01)

(52) U.S. Cl.
CPC ... *G09G 3/3266* (2013.01); *G09G 2320/0214* (2013.01); *G09G 2330/021* (2013.01)

(58) Field of Classification Search
CPC .. G09G 3/20; G09G 3/30; G09G 3/32; G09G 3/3208; G09G 3/3225; G09G 3/3233; G09G 3/325; G09G 3/3258; G09G 3/3266; G09G 3/3291; G09G 2300/0426; G09G 2300/0439; G09G 2300/0809;
(Continued)

(56) References Cited

U.S. PATENT DOCUMENTS 7,911,423 B2 3/2011 Kim et al.
8,692,821 B2 4/2014 Park
(Continued)

FOREIGN PATENT DOCUMENTS

KR 10-1054327 8/2011
KR 10-2014-0117121 10/2014
(Continued)

*Primary Examiner* — Keith L Crawley
(74) *Attorney, Agent, or Firm* — H.C. Park & Associates, PLC

(57) ABSTRACT

A pixel circuit includes: an organic light emitting diode (OLED); a first transistor having first and second electrodes and a first gate electrode; a second transistor connected between a data line and the first electrode, controlled by a first scan line; a third transistor connected between the second electrode and the a electrode of the first transistor, controlled by the first scan line; a fourth transistor connected between the first gate electrode and a first initialization voltage line, controlled by a second scan line; a fifth transistor connected between a power line and first electrode, controlled by a first emission line; a sixth transistor connected between the second electrode and the OLED and controlled by a second emission line; and a storage capacitor connected between the first gate electrode and the power line, wherein the first emission line and the second emission line are located at different nodes.

18 Claims, 9 Drawing Sheets

(58) Field of Classification Search
CPC ... G09G 2300/0814; G09G 2300/0819; G09G 2300/0842; G09G 2310/0202; G09G 2310/0251; G09G 2310/0262; G09G 2320/0214; G09G 2320/0233; G09G 2330/021; H01L 27/3244; H01L 27/3276
See application file for complete search history.

(56) References Cited

U.S. PATENT DOCUMENTS

| | | | | |
|---|---|---|---|---|
| 2015/0002560 | A1* | 1/2015 | Kwon | G09G 3/3266 345/691 |
| 2015/0255523 | A1* | 9/2015 | Her | G09G 3/3233 345/76 |
| 2016/0133190 | A1* | 5/2016 | Kim | G09G 3/2011 345/80 |
| 2016/0379552 | A1* | 12/2016 | Kim | G09G 3/3208 345/76 |
| 2017/0033173 | A1* | 2/2017 | Kim | G09G 3/3225 |
| 2017/0061876 | A1* | 3/2017 | Cho | G09G 3/3258 |
| 2017/0092200 | A1* | 3/2017 | Park | G09G 3/3233 |
| 2017/0124941 | A1* | 5/2017 | Na | G09G 3/3233 |
| 2017/0249896 | A1* | 8/2017 | Kim | H01L 27/124 |
| 2017/0263187 | A1* | 9/2017 | Zhu | G09G 3/3233 |
| 2017/0358641 | A1* | 12/2017 | Park | G09G 3/3233 |
| 2017/0365214 | A1* | 12/2017 | Tsai | G09G 3/3233 |
| 2018/0144684 | A1* | 5/2018 | Jeon | H01L 27/3276 |
| 2018/0174525 | A1* | 6/2018 | Kim | G09G 3/3291 |
| 2020/0273411 | A1* | 8/2020 | Gao | G09G 3/3291 |
| 2021/0280132 | A1* | 9/2021 | Gao | G09G 3/3233 |

FOREIGN PATENT DOCUMENTS

| | | |
|---|---|---|
| KR | 10-1456022 | 11/2014 |
| KR | 10-2016-0056234 | 5/2016 |
| KR | 10-2016-0057229 | 5/2016 |
| KR | 10-1779076 | 9/2017 |
| KR | 10-2018-0003790 | 1/2018 |

* cited by examiner

PIXEL CIRCUIT IN WHICH A DRIVING TRANSISTOR IS ALLOWED TO BE ON-BIASED TO PREVENT UNINTENDED EMISSION

CROSS-REFERENCE TO RELATED APPLICATION

The present application claims priority from and the benefit of Korean Patent Application No. 10-2018-0098582, filed on Aug. 23, 2018, which is hereby incorporated by reference for all purposes as if fully set forth herein.

BACKGROUND

Field

Exemplary embodiments of the invention relate generally to a pixel circuit.

Discussion of the Background

With the development of information technologies, the importance of a display device as a connection medium between a user and information has increased. Accordingly, display devices such as a liquid crystal display device, an organic light emitting display device, and a plasma display device are increasingly used.

An organic light emitting display device displays an image using an organic light emitting diode that generates light by recombination of electrons and holes. The organic light emitting display device has a high response speed and is driven with low power consumption.

Recently, research has been made to solve a hysteresis issue and a step efficiency issue by allowing a driving transistor of a pixel circuit for driving an organic light emitting diode to be on-biased in advance.

The above information disclosed in this Background section is only for understanding of the background of the inventive concepts, and, therefore, it may contain information that does not constitute prior art.

SUMMARY

Devices constructed according to exemplary implementations of the invention provide a pixel circuit capable of preventing or reducing occurrence of unintended emission and over-current and reducing power consumption by allowing a driving transistor to be on-biased.

Additional features of the inventive concepts will be set forth in the description which follows, and in part will be apparent from the description, or may be learned by practice of the inventive concepts.

According to one or more exemplary embodiments of the invention, a pixel circuit includes: an organic light emitting diode; a first transistor including a source electrode, a drain electrode, and a gate electrode; a second transistor having a source electrode connected to a data line, a drain electrode connected to the source electrode of the first transistor, and a gate electrode connected to a first scan line; a third transistor having a source electrode connected to the drain electrode of the first transistor, a drain electrode connected to the gate electrode of the first transistor, and a gate electrode connected to the first scan line; a fourth transistor having a source electrode connected to the gate electrode of the first transistor, a drain electrode connected to a first initialization voltage line, and a gate electrode connected to a second scan line; a fifth transistor having a source electrode connected to a first power voltage line, a drain electrode connected to the source electrode of the first transistor, and a gate electrode connected to a first emission line; a sixth transistor having a source electrode connected to the drain electrode of the first transistor, a drain electrode connected to an anode electrode of the organic light emitting diode, and a gate electrode connected to a second emission line; and a storage capacitor having a first electrode connected to the gate electrode of the first transistor and a second electrode connected to the first power voltage line, wherein the first emission line and the second emission line are located at different nodes.

The first emission line and the second emission line may be configured to transmit a first emission signal and a second emission signal, respectively, and the first emission signal may have a phase delayed compared with that of the second emission signal.

The first scan line and the second scan line may be located at different nodes.

The first scan line and the second scan line may be configured to transmit a first scan signal and a second scan signal, respectively, and the first scan signal may have a phase delayed compared with that of the second scan signal.

A turn-on level pulse of the first scan signal may partially overlap with a turn-off level pulse of the first emission signal.

A turn-on level pulse of the second scan signal may partially overlap with a turn-off level pulse of the second emission signal.

A generation of turn-on level pulse of the second scan signal may overlap the first emission signal has a turn-on level.

The turn-on level pulse of the second scan signal may partially overlap with a transition time of the turn-off level pulse of the first emission signal.

The pixel circuit may further include a seventh transistor having a source electrode connected to the anode electrode of the organic light emitting diode, a drain electrode connected to a second initialization voltage line, and a gate electrode connected to a third scan line.

A turn-on level pulse of a third scan signal applied to the third scan line may partially overlap with a transition time of the turn-off level pulse of the second emission signal applied to the second emission line.

The pixel circuit may further include a first gate insulating layer covering the source electrodes, the drain electrodes, and channels of the first to seventh transistors. The gate electrodes of the first to seventh transistors, the first to third scan lines, the first and second emission lines, the first and second initialization voltage lines, and the one electrode of the storage capacitor may be located on the first gate insulating layer.

The pixel circuit may further include a second gate insulating layer covering the first gate insulating layer, the gate electrodes of the first to seventh transistors, the first to third scan lines, the first and second emission lines, the first and second initialization voltage lines, and the one electrode of the storage capacitor. The other electrode of the storage capacitor may be located on the second gate insulating layer.

The pixel circuit may further include: an interlayer insulating layer covering the second gate insulating layer and the other electrode of the storage capacitor; and a first contact electrode located on the interlayer insulating layer, the first contact electrode being connected to the source electrode of the seventh transistor. The data line and the first power voltage line may be located on the interlayer insulating layer.

The pixel circuit may further include a via layer covering the interlayer insulating layer, the first contact electrode, the data line, and the first power voltage line. The anode electrode of the organic light emitting diode may be located on the via layer, and be connected to the source electrode of the seventh transistor through the first contact electrode.

The third scan line, the second emission line, the second initialization voltage line, the first scan line, the second scan line, the first emission line, and the first initialization voltage line may be sequentially located on the same layer in a first direction.

The second initialization voltage line may vertically overlap with a point at which the source electrode of the sixth transistor and the drain electrode of the first transistor are in contact with each other.

The second initialization voltage line may vertically overlap with a point at which the source electrode of the sixth transistor and the drain electrode of the third transistor are in contact with each other.

The second initialization voltage line may be connected to a drain electrode of a fourth transistor of a previous stage pixel circuit.

The third scan line may be connected to a gate electrode of the fourth transistor of the previous stage pixel circuit.

The first initialization voltage line may be connected to a drain electrode of a seventh transistor of a next stage pixel circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
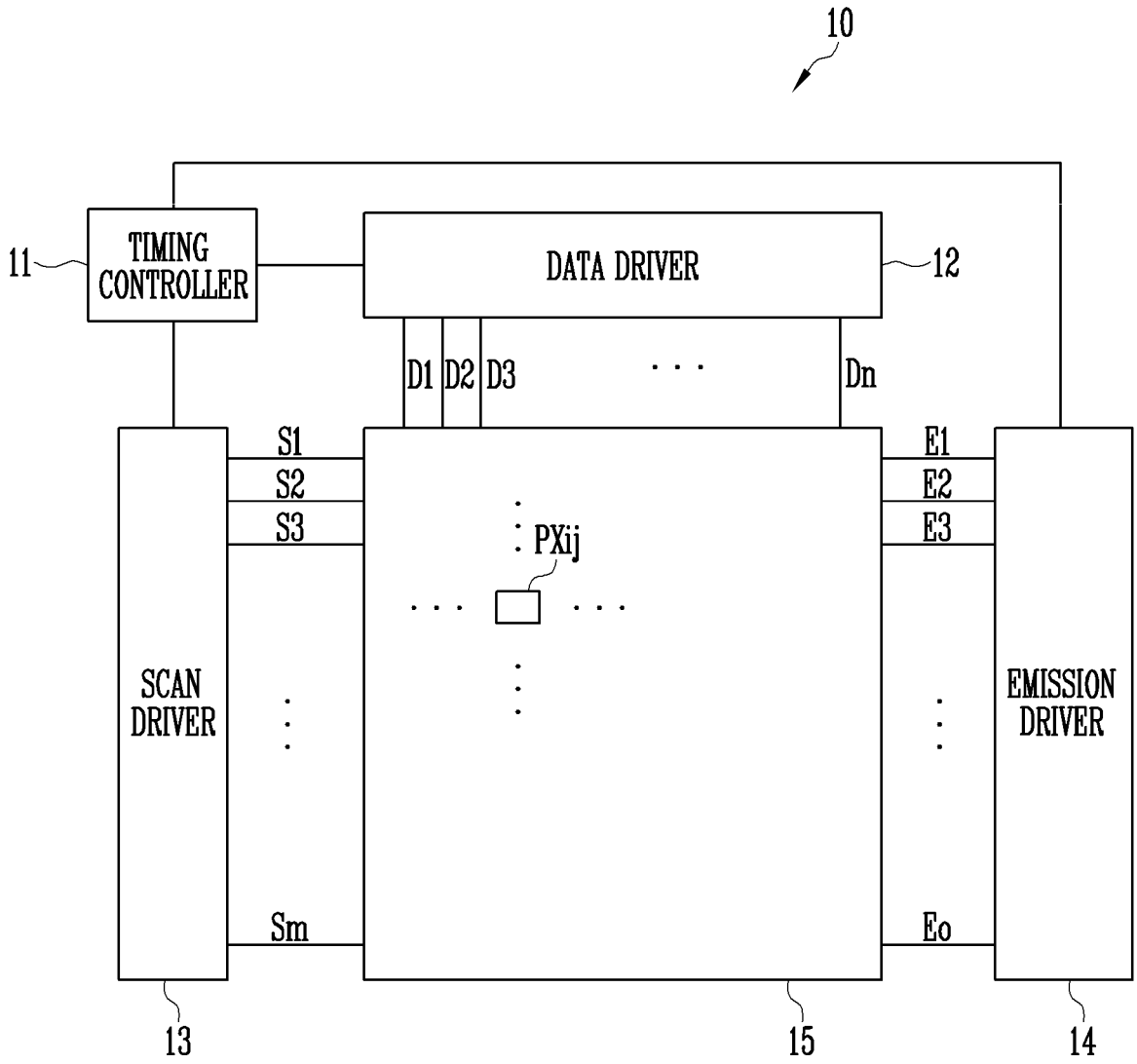
FIG. 1 is a diagram illustrating a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side"

(e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a diagram illustrating a display device 10 according to an exemplary embodiment.

Referring to FIG. 1, the display device 10 may include a timing controller 11, a data driver 12, a scan driver 13, an emission driver 14, and a pixel unit 15.

The timing controller 11 may provide grayscale values and control signals to the data driver 12 to be suitable for specifications of the data driver 12. Also, the timing controller 11 may provide a clock signal, a scan start signal, etc. to the scan driver 13 to be suitable for specifications of the scan driver 13. Also, the timing controller 11 may provide a clock signal, an emission stop signal, etc. to the emission driver 14 to be suitable for specifications of the emission driver 14.

The data driver 12 may generate data voltages to be provided to data lines D1, D2, D3, . . . , and Dn, using the grayscale values and control signals, which are received from the timing controller 11. For example, the data driver 12 may sample grayscale values, using a clock signal, and apply data voltages corresponding to the grayscale values to the data lines D1 to Dn in units of pixel rows. Here, n may be a natural number.

The scan driver 13 may generate scan signals to be provided to scan lines S1, S2, S3, . . . , and Sm by receiving the clock signal, the scan start signal, etc. from the timing controller 11. For example, the scan driver 13 may sequentially provide the scan signals having a turn-on level pulse to the scan line S1 to Sm. For example, the scan driver 13 may be configured in the form of a shift register, and generate the scan signals in a manner that sequentially transfers the scan start signal provided in the form of a turn-on level pulse to a next stage circuit under the control of the clock signal.

The emission driver 14 may generate emission signals to be provided to emission lines E1, E2, E3, . . . , and Eo by receiving the clock signal, the emission stop signal, etc. from the timing controller 11. For example, the emission driver 14 may sequentially provide the emission signals having a turn-off level pulse to the emission lines E1, E2, E3, . . . , and Eo. For example, the emission driver 14 may be configured in the form of a shift register, and generate the emission signals in a manner that sequentially transfers the emission stop signal provided in the form of a turn-off level pulse to a next stage circuit under the control of the clock signal. Here, o may be a natural number.

The pixel unit 15 includes a plurality of pixel circuits. Each pixel circuit PXij may be connected to a corresponding data line, a corresponding scan line, and a corresponding emission line. A configuration and driving method of the pixel circuit PXij will be described in detail with reference to drawings from FIG. 5. Here, i and j may be natural numbers. The pixel circuit PXij may mean a pixel circuit in which a scan transistor is connected to an ith scan line and is connected to a jth data line.

In exemplary embodiments, the timing controller 11, the data driver 12, the scan driver 13, the emission driver 14, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to one or more exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the timing controller 11, the data driver 12, the scan driver 13, the emission driver 14, and/or one or more components thereof may include or otherwise be associated with one or more memories (not shown) including code (e.g., instructions) configured to cause the timing controller 11, the data driver 12, the scan driver 13, the emission driver 14, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CD-RW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 2:
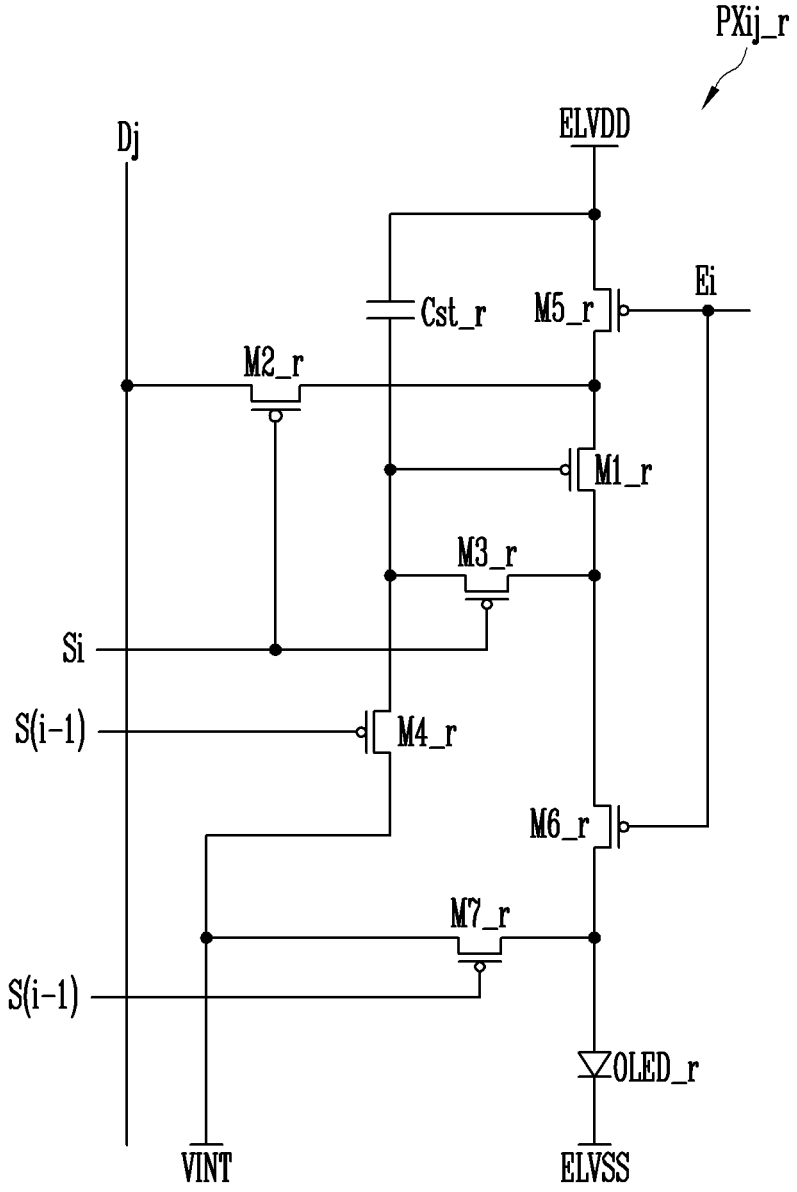
FIG. 2 (Related Art)
FIGS. 2, 3, and 4 are diagrams illustrating a pixel circuit and driving methods thereof according to a related art.
Figure 3:
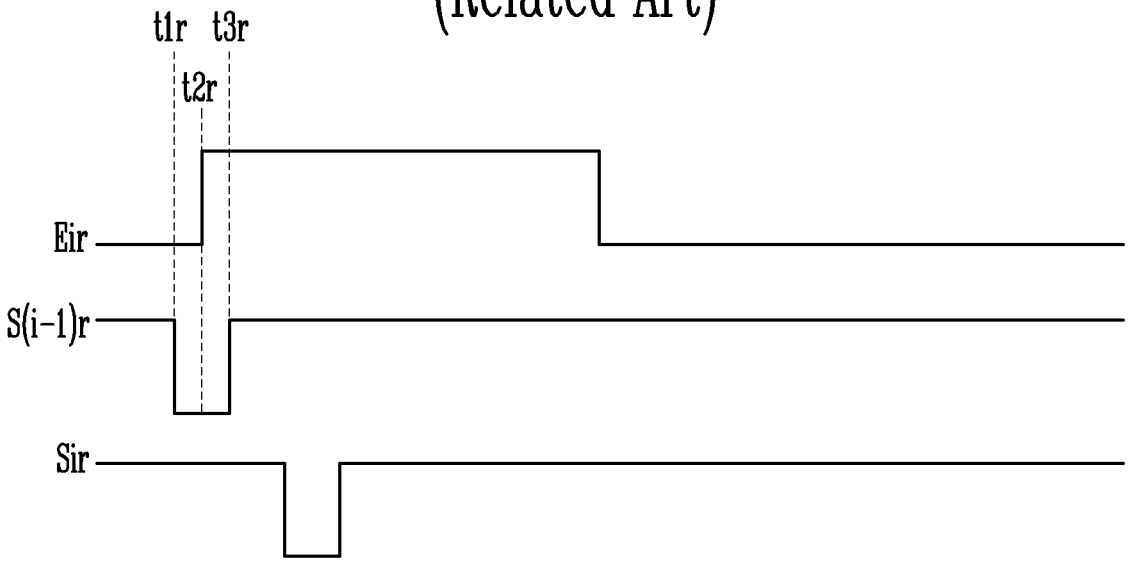
FIG. 3 (Related Art)
Figure 4:
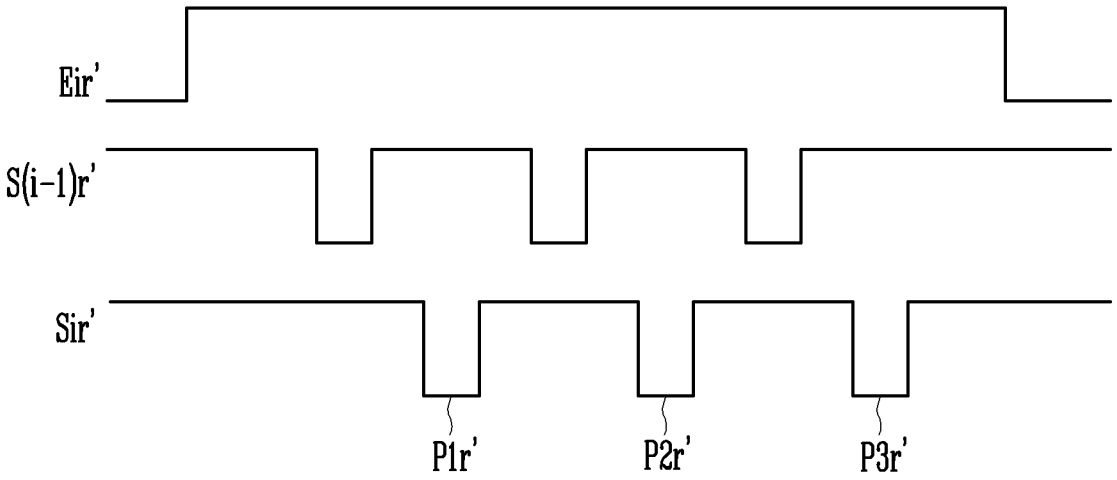
FIG. 4 (Related Art)

FIGS. 2, 3, and 4 are diagrams illustrating a pixel circuit PXij_r and driving methods thereof according to a related art.

Referring to FIG. 2, the pixel circuit PXij_r includes first to seventh transistors M1_*r*, M2_*r*, M3_*r*, M4_*r*, M5_*r*, M6_*r*, and M7_*r*, a storage capacitor Cst_r, and an organic light emitting diode OLED_r.

A first transistor M1_*r* may include a source electrode, a drain electrode, and a gate electrode. The first transistor M1_*r* may be referred to as a driving transistor.

A source electrode of a second transistor M2_*r* may be connected to a data line Dj, a drain electrode of the second transistor M2_*r* may be connected to the source electrode of the first transistor M1_*r*, and a gate electrode of the second transistor M2_*r* may be connected to a scan line Si. The second transistor M2_*r* may be referred to as a scan transistor or switching transistor.

A source electrode of a third transistor M3_*r* may be connected to the drain electrode of the first transistor M1_*r*, a drain electrode of the third transistor M3 may be connected to the gate electrode of the first transistor M1_*r*, and a gate electrode of the third transistor M3 may be connected to the scan line Si.

A source electrode of a fourth transistor M4_*r* may be connected to the gate electrode of the first transistor M1_*r*, a drain electrode of the fourth transistor M4_*r* may be connected to an initialization voltage line VINT, and a gate electrode of the fourth transistor M4_*r* may be connected to a previous stage scan line S(i−1).

A source electrode of a fifth transistor M5_*r* may be connected to a first power voltage line ELVDD, a drain electrode of the fifth transistor M5_*r* may be connected to the source electrode of the first transistor M1_*r*, and a gate electrode of the fifth transistor M5_*r* may be connected to an emission line Ei.

A source electrode of a sixth transistor M6_*r* may be connected to the drain electrode of the first transistor M1_*r*, a drain electrode of the sixth transistor M6_*r* may be connected to an anode electrode of the organic light emitting diode OLED_r, and a gate electrode of the sixth transistor M6_*r* may be connected to the emission line Ei.

A source electrode of a seventh transistor M7_*r* may be connected to the anode electrode of the organic light emitting diode OLED_r, a drain electrode of the seventh transistor M7_*r* may be connected to the initialization voltage line VINT, and a gate electrode of the seventh transistor M7_*r* may be connected to the previous stage scan line S(i−1).

One electrode of the storage capacitor Cst_r may be connected to the gate electrode of the first transistor M1_*r*, and the other electrode of the storage capacitor Cst_r may be connected to the first power voltage line ELVDD.

The anode electrode of the organic light emitting diode OLED_r may be connected to the source electrode of the seventh transistor M7_*r*, and a cathode electrode of the organic light emitting diode OLED_r may be connected to a second power voltage line ELVSS.

First, a case where the pixel circuit PXij_r is driven using a driving method of FIG. 3 will be described.

Referring to FIG. 3, an emission signal Eir is applied to the emission line Ei, a previous stage scan signal S(i−1)r is applied to the previous stage scan line S(i−1), and a scan signal Sir is applied to the scan line Si.

During a period t1*r* to t2*r*, the emission signal Eir becomes a turn-on level, and the previous stage scan signal S(i−1)r becomes a turn-off level. Since the first to seventh transistors M1_*r*, M2_*r*, M3_*r*, M4_*r*, M5_*r*, M6_*r*, and M7_*r* of the pixel circuit PXij_r are P-type transistors, the turn-on level may be a low level voltage, and the turn-off level may be a high level voltage.

Therefore, the transistors M4_*r*, M5_*r*, M6_*r*, and M7_*r* are in a turn-on state. In addition, the gate electrode of the first transistor M1_*r* is connected to the initialization voltage line VINT through the fourth transistor M4_*r*, and hence the first transistor M1_*r* is also in the turn-on state. For example, the voltage level of an initialization voltage applied to the initialization voltage line VINT may be equal to or lower than that of a second power voltage applied to the second power voltage line ELVSS. The voltage level of a first power voltage applied to the first power voltage line ELVDD may be higher than that of the second power voltage.

Therefore, the source electrode of the first transistor M1_*r* is connected to the first power voltage line ELVDD through the fifth transistor M5_*r*, and the gate electrode of the first transistor M1_*r* is connected to the initialization voltage line VINT through the fourth transistor M4_*r*. Hence, the first transistor M1_*r* to which a high gate-source voltage is applied is in an on-bias state during the period t1*r* to t2*r*.

When the first transistor M1_*r* is in the on-bias state, a data voltage of a current frame, which is input subsequently, is always lower than the on-bias voltage. Hence, the data voltage of the current frame is irrelevant to the magnitude of a data voltage of a previous frame. Thus, a hysteresis issue and a step efficiency issue can be solved.

The hysteresis issue means an issue where a curve of the gate-source voltage versus source-drain current of a transistor when a data voltage of a current frame is higher than that of a previous frame is different from a curve of the gate-source voltage versus source-drain current of the transistor when the data voltage of the current frame is lower than that of the previous frame. The step efficiency issue means an issue where, when a grayscale is rapidly changed in units of frames (e.g., when a black grayscale of a previous frame is changed to a white grayscale in a current frame), a luminance corresponding to an intermediate grayscale instead of a target grayscale is exhibited due to a difference between such curves.

During a period t2*r* to t3*r*, the transistors M5_*r* and M6_*r* are turned off. Since the transistors M4_*r* and M7_*r* maintain the turn-on state, charges stored in the storage capacitor Cst_r and charges stored in the organic light emitting diode OLED_r are initialized according to the initialization voltage.

Next, the transistors M2_*r* and M3_*r* are turned on by a turn-on level pulse of the scan signal Sir, and a data voltage is written in the storage capacitor Cst_r through the data line Dj and the transistors M2_*r*, M1_*r*, and M3_*r*.

Next, the level of the emission signal Eir is changed to the turn-on level, so that the transistors M5_*r* and M6_*r* are turned on. Accordingly, the organic light emitting diode OLED_r emits light while a driving current is flowing through a driving current path connecting the first power voltage line ELVDD, the transistors M5_*r*, M1_*r*, and M6_*r*, the organic light emitting diode OLED_r, and the second power voltage line ELVSS. An amount of driving current is determined by the first transistor M1_*r*, based on the voltage written in the storage capacitor Cst_r.

However, the driving method of FIG. 3 has several problems.

First, there is a problem in that a pulse of the previous stage scan signal S(i−1)r, which is generated in the period t1*r* to t3*r*, is to partially overlap with a transition time of the emission signal Eir. The term "transition" means that the logic level of a signal is changed. For example, a case where the logic level of the signal is changed from a low level to a high level may be expressed as a rising transition, and a case where the logic level of the signal is changed from the high level to the low level may be expressed as a falling transition. In an actual product, a required overlapping time is about 1 μs, and therefore, it may be difficult to allow the pulse of the previous stage scan signal S(i−1)r to accurately overlap with the transition time of the emission signal Eir.

In addition, since the period t1*r* to t2*r* is a period in which the organic light emitting diode OLED_r emits light, the organic light emitting diode OLED_r may emit light with an unintended luminance level. In order to maximally suppress this, the path through which the driving current flows may be changed by turning on the seventh transistor M7_*r*. However, since the initialization voltage is applied to the gate electrode of the first transistor M1_*r*, an over-current flows from the first power voltage line ELVDD to the initialization voltage line VINT, and hence the lines may be burnt out. Therefore, a problem of over-power consumption may occur.

In addition, when the initialization voltage is applied to the gate electrode of the first transistor M1_*r* while the black grayscale is being expressed, a current instantaneously flows through the organic light emitting diode OLED_r, and therefore, there may occur a problem in that the black grayscale cannot be maintained.

Next, a case where the pixel circuit PXij_r is driven using a driving method of FIG. 4 will be described.

Referring to FIG. 4, an emission signal Eir' is applied to the emission line Ei, a previous stage scan signal S(i−1)r' is applied to the previous stage scan line S(i−1), and a scan signal Sir' is applied to the scan line Si.

In the driving method of FIG. 4, data voltages of a previous stage pixel row and a pixel row before the previous stage pixel row are applied to the gate electrode of the first transistor M1_*r* by a first pulse P1*r*' and a second pulse P2*r*' of the scan signal Sir', so that the first transistor M1_*r* is on-biased. A data voltage of a current stage pixel row is written by a third pulse P3*r*' of the scan signal Sir'. Subsequently, the organic light emitting diode OLED_r may emit light with the data voltage of the current stage pixel row when the level of the emission signal Eir' becomes the turn-on level.

Like the driving method of FIG. 3, the driving method of FIG. 4 also has an advantage in that the first transistor M1_*r* is on-biased. However, the driving method of FIG. 4 may also have several shortcomings.

First, a plurality of pulses are to be applied to each of the scan lines S1, S2, S3, . . . , and Sm, and accordingly, a turn-off level pulse of the emission signal Eir' is to be maintained long. Therefore, there is a problem in that the emission time of the organic light emitting diode OLED_r is decreased, and power consumption is increased since the number of rising/falling operations increases in a built-in circuit of the emission driver 14.

In addition, since the data voltages of the previous stage pixel row and the pixel row before the previous stage pixel row are not ensured to the white grayscale, the on-bias voltage may be changed for each frame, and therefore, there is a problem in that the effect obtained by the on-bias voltage cannot be ensured.

Figure 5:
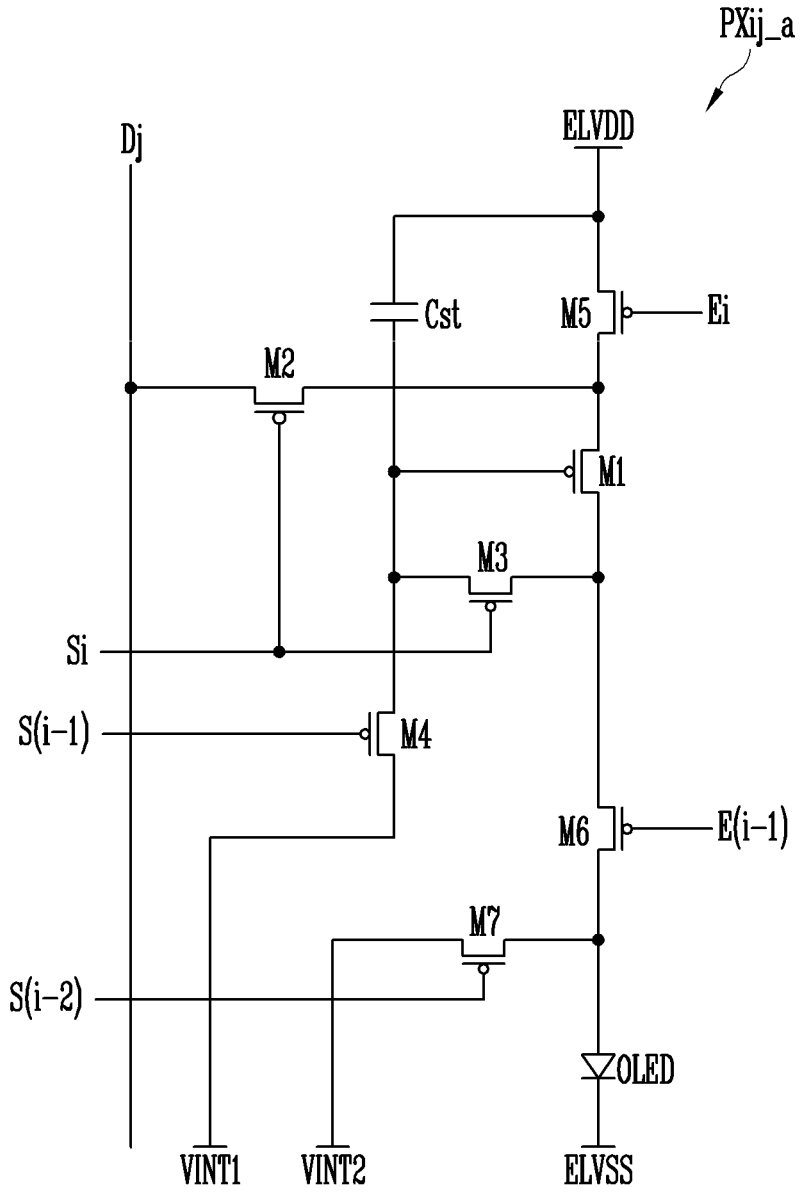
FIG. 5 is a diagram illustrating a pixel circuit according to an exemplary embodiment.

FIG. 5 is a diagram illustrating a pixel circuit according to an exemplary embodiment.

Referring to FIG. 5, the pixel circuit PXij_a includes first to seventh transistors M1, M2, M3, M4, M5, M6, and M7, a storage capacitor Cst, and an organic light emitting diode OLED.

A first transistor M1 may include a source electrode, a drain electrode, and a gate electrode. The first transistor M1 may be referred to as a driving transistor.

A source electrode of a second transistor M2 may be connected to a data line Dj, a drain electrode of the second transistor M2 may be connected to the source electrode of the first transistor M1, and a gate electrode of the first transistor M1 may be connected to a first scan line Si. The second transistor M2 may be referred to as a scan transistor or switching transistor.

A source electrode of a third transistor M3 may be connected to the drain electrode of the first transistor M1, a drain electrode of the third transistor M3 may be connected to the gate electrode of the first transistor M1, and a gate electrode of the third transistor M3 may be connected to the first scan line Si. In some embodiments, the third transistor M3 may include a plurality of sub-transistors connected in series so as to prevent or reduce a leakage current.

A source electrode of a fourth transistor M4 may be connected to the gate electrode of the first transistor M1, a drain electrode of the fourth transistor M4 may be connected to a first initialization voltage line VINT1, and a gate electrode of the fourth transistor M4 may be connected to a second scan line S(i−1). In some embodiments, the fourth transistor M4 may include a plurality of sub-transistors connected in series so as to prevent or reduce a leakage current.

A source electrode of a fifth transistor M5 may be connected to a first power voltage line ELVDD, a drain electrode of the fifth transistor M5 may be connected to the source electrode of the first transistor M1, and a gate electrode of the fifth transistor M5 may be connected to a first emission line Ei.

A source electrode of a sixth transistor M6 may be connected to the drain electrode of the first transistor M1, a drain electrode of the sixth transistor M6 may be connected to an anode electrode of the organic light emitting diode OLED, and a gate electrode of the sixth transistor M6 may be connected to a second emission line E(i−1).

A source electrode of a seventh transistor M7 may be connected to the anode electrode of the organic light emitting diode OLED, a drain electrode of the seventh transistor M7 may be connected to a second initialization voltage line VINT2, and a gate electrode of the seventh transistor M7 may be connected to a third scan line S(i−2).

One electrode of the storage capacitor Cst may be connected to the gate electrode of the first transistor M1, and the other electrode of the storage capacitor Cst may be connected to the first power voltage line ELVDD.

The anode electrode of the organic light emitting diode OLED may be connected to the source electrode of the seventh transistor M7, and a cathode electrode of the organic light emitting diode OLED may be connected to a second power voltage line ELVSS.

The first emission line Ei and the second emission line E(i−1) may be located at different nodes. That is, a first emission signal applied to the first emission line Ei and a second emission signal applied to the second emission line E(i−1) may be different from each other. For example, the first emission line Ei may be an ith emission line, and the second emission line E(i−1) may be an (i−1)th emission line. Here, i is a natural number equal to or greater than 3 and equal to or smaller than m.

The first scan line Si and the second scan line S(i−1) may be located at different nodes. That is, a first scan signal applied to the first scan line Si and a second scan signal applied to the second scan line S(i−1) may be different from each other. For example, the first scan line Si may be an ith scan line, and the second scan line S(i−1) may be an (i−1)th scan line.

According to an embodiment, the third scan line S(i−2) may be located at a node different from those of the first and second scan lines Si and S(i−1). That is, a third scan signal applied to the third scan line S(i−2) may be different from the first and second scan signals. For example, the third scan line S(i−2) may be an (i−2)th scan line.

According to another exemplary embodiment, the third scan line S(i−2) may be located at the same node as the first scan line Si or the second scan line S(i−1). For example, the third scan line S(i−2) is a line physically different from the first and second lines Si and S(i−1), but may be located at a node electrically identical to that of the first scan line Si or the second scan line S(i−1). An electrode in another layer may be used as a bridge electrode so as to electrically connect the third scan line S(i−2) to the first scan line Si or the second scan line S(i−1).

Hereinafter, for convenience of description, a case where the third scan line S(1−2) is located at a node different from those of the first and second scan lines Si and S(i−1) is described.

The first initialization voltage line VINT1 and the second initialization voltage line VINT2 may be physically different lines. In some embodiments, the first initialization voltage line VINT1 and the second initialization voltage line VINT2 are located at different nodes, and therefore, a first initialization voltage and a second initialization voltage may be different from each other. In another exemplary embodiment, the first initialization voltage line VINT1 and the second initialization voltage line VINT2 are located at the same node, and therefore, the first initialization voltage and the second initialization voltage may be the same. The first initialization voltage line VINT1 and the second initialization voltage line VINT2 may be connected to each other, using an electrode in another layer as a bridge electrode.

According to the exemplary embodiment, the pixel circuit PX1*j*_a and PX2*j*_a on the first and second rows, respectively, each components are connected in substantially the same way with the pixel circuits PXij_a except for the connection with the second scan line S(i−1) and the third scan line S(i−2). According to the exemplary embodiments, in the pixel circuit PX1*j* of the first row, an $m^{th}$ scan line Sm and an $(m-1)^{th}$ scan line S(m−1) may be connected in place of the second scan line S(i−1) and the third scan line S(i−2). Particularly, in the pixel circuit PX1*j*, the gate electrode of the fourth transistor M4 and the gate electrode of the sixth transistor M6 may be connected to a $m^{th}$ emission line Em, and the gate electrode of the seventh transistor M7 may be connected to the $(m-1)^{th}$ scan line S(m−1). According to the exemplary embodiments, in the pixel circuit PX2*j* of the second row, the $m^{th}$ scan line Sm may be connected in place of the third scan line S(i−2). Particularly, in the pixel circuit PX2*j*: the gate electrode of the seventh transistor M7 may be connected to the $m^{th}$ scan line Sm.

Figure 6:
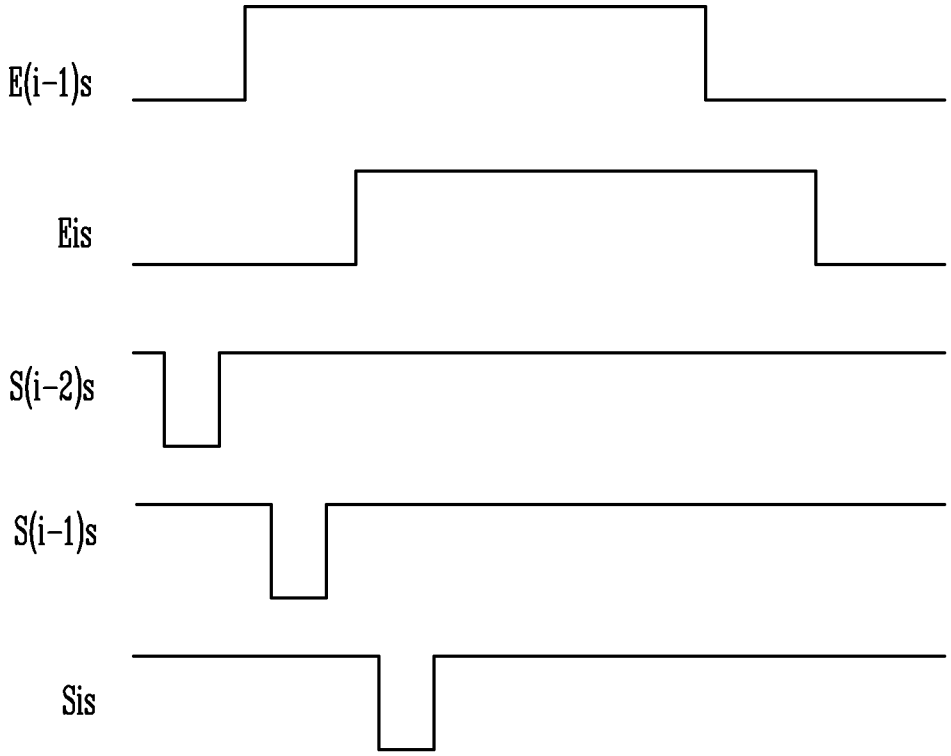
FIG. 6 is a diagram illustrating a driving method of the pixel circuit according to an exemplary embodiment.

FIG. 6 is a diagram illustrating a driving method of the pixel circuit according to an exemplary embodiment.

Referring to FIG. 6, there are illustrated a first emission signal Eis applied to the first emission line Ei, a second emission signal E(i−1)s applied to the second emission line E(i−1), a first scan signal Sis applied to the first scan line Si, a second scan signal S(i−1)s applied to the second scan line S(i−1), and a third scan signal S(i−2)s applied to the third scan line S(i−2).

The phase of the first emission signal Eis may be delayed as compared with that of the second emission signal E(i−1)s. The phase of the first scan signal Sis may be delayed as compared with that of the second scan signal S(i−1)s. The phase of the second scan signal S(i−1)s may be delayed as compared with that of the third scan signal S(i−2)s.

A turn-on level pulse of the first scan signal Sis may partially overlap with a turn-off level pulse of the first emission signal Eis. A turn-on level pulse of the second scan signal S(i−1)s may partially overlap with a turn-off level pulse of the second emission signal E(i−1)s. The turn-on level pulse of the second scan signal S(i−1)s may be generated when the first emission signal Eis is a turn-on level. A turn-on level pulse of the third scan signal S(i−2)s may be generated when the first and second emission signals Eis and E(i−1)s become the turn-on level.

First, when the third scan signal S(i−2)s becomes the turn-on level, the seventh transistor M7 is turned on. Accordingly, the anode electrode of the organic light emitting diode OLED is connected to the second initialization voltage line VINT2, and charges stored in the anode electrode are initialized to a second initialization voltage.

There is formed a current path connecting the first power voltage line ELVDD, the transistors M5, M1, M6, and M7, and the second initialization voltage line VINT2. However, as compared with the case of FIG. 3, an initialization voltage is not applied to the gate electrode of the first transistor M1, and hence an over-current does not flow in the formed current path. That is, since a data voltage corresponding to a corresponding grayscale is applied to the gate electrode of the first transistor M1, an amount of current corresponding to the corresponding grayscale flows, and thus power consumption is not increased.

Next, the second emission signal E(i−1)s becomes a turn-off level, and hence the sixth transistor M6 is turned off. In addition, the second scan signal S(i−1)s becomes the turn-on level, and hence the fourth transistor M4 is turned on. The fifth transistor M5 is in the turn-on state due to the first emission signal Eis that becomes the turn-on level. Therefore, the source electrode of the first transistor M1 is connected to the first power voltage line ELVDD, and the gate electrode of the first transistor M1 is connected to the first initialization voltage line VINT1. Hence, the first transistor M1 is on-biased.

As compared with the driving method of FIG. 3, the sixth transistor M6 is in a turn-off state, and the organic light emitting diode OLED does not emit light. Thus, unintended emission does not occur. Further, when a black grayscale is expressed, the black grayscale can be well expressed without abnormality.

As compared with the driving method of FIG. 4, data voltages of a previous stage pixel row and a pixel row before the previous stage pixel row, which may be changed for each frame, are not applied to the gate electrode of the first transistor M1, but a first initialization voltage is always applied to the gate electrode of the first transistor M1. Thus, the first transistor M1 can be stably on-biased.

Next, the first emission signal Eis becomes the turn-off level, and hence the fifth transistor M5 is turned off. In addition, the first scan signal Sis becomes the turn-on level, and hence the transistors M2 and M3 are turned on. Accordingly, a data voltage is applied to the one electrode of the storage capacitor Cst through the data line Dj and the transistors M2, M1, and M3, and the storage capacitor Cst records a difference between the data voltage and the first power voltage. A threshold voltage decrement of the first transistor M1 can be reflected to the recorded data voltage.

Next, as the second and first emission signals E(i−1)s and Eis sequentially become the turn-on level, the sixth and fifth transistors M6 and M5 are sequentially turned on. Accordingly, there is formed a driving current path connecting the first power voltage line ELVDD, the transistors M5, M1, and M6, the organic light emitting diode OLED, and the second power voltage line ELVSS. An amount of driving current flowing through the driving current path may be determined according to an amount of voltage stored in the storage capacitor Cst, which is applied to the gate electrode of the first transistor M1.

According to the exemplary embodiment, the pixel circuit PX1*j*_a and PX2*j*_a on the first and second rows, respectively, are operated in substantially the same way with the pixel circuits PXij_a except for the application of the second scan signal S(i−1)s and the third scan signal S(i−2)s; i.e. an $m^{th}$ scan signal Sms and an $(m-1)^{th}$ scan signal S(m−1)s of the previous frame directly preceding the current frame may be applied in place of the second scan signal S(i−1)s and the third scan signal S(i−2)s, and an $m^{th}$ emission signal Ems of the previous frame may be applied in place of the second emission signal E(i−1).

As compared with the driving method of FIG. 4, the scan signals S(i−2)s, S(i−1)s, and Sis do not necessarily include a plurality of pulses, and hence, the turn-off level pulses of the emission signals E(i−1)s and Eis are not necessarily maintained long. Thus, the emission time of the organic light emitting diode OLED is not decreased, and the power consumption of the emission driver 14 is not increased.

Figure 7:
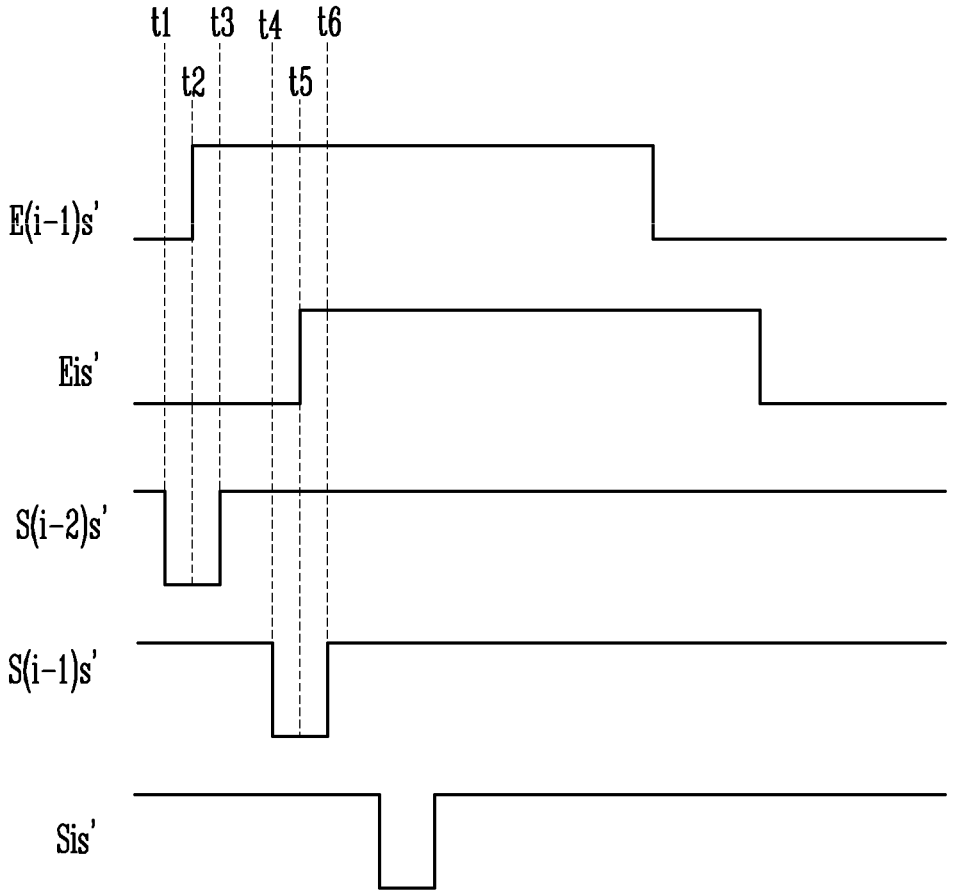
FIG. 7 is a diagram illustrating a driving method of the pixel circuit according to another exemplary embodiment.

FIG. 7 is a diagram illustrating a driving method of the pixel circuit according to another exemplary embodiment.

Referring to FIG. 7, there are illustrated a first emission signal Eis' applied to the first emission line Ei, a second emission signal E(i−1)s' applied to the second emission line E(i−1), a first scan signal Sis' applied to the first scan line Si, a second scan signal S(i−1)s' applied to the second scan line S(i−1), and a third scan signal S(i−2)s' applied to the third scan line S(i−2).

A turn-on level pulse of the second scan signal S(i−1)s' may partially overlap with a transition time of a turn-off level pulse of the first emission signal Eis'. For example, at a time t5, the turn-on level pulse of the second scan signal S(i−1)s' may partially overlap with a rising transition time of the first emission signal Eis'.

A turn-on level pulse of the third scan signal S(i−2)s' may partially overlap with a transition time of a turn-off level pulse of the second emission signal E(i−1)s'. For example, at a time t2, the turn-on level pulse of the third scan signal S(i−2)s' may partially overlap with a rising transition time of the second emission signal E(i−1)s'.

First, during a period t1 to t2, the third scan signal S(i−2)s', the first emission signal Eis', and the second emission signal E(i−1)s' become the turn-on level, and hence a driving current flows through the second initialization voltage line VINT2 or the organic light emitting diode OLED. The flowing current may be changed depending on a condition of each voltage. An initialization voltage is not applied to the gate electrode of the first transistor M1, but a data voltage corresponding to a grayscale is applied to the gate electrode of the first transistor M1. Thus, current consumption is not increased.

Next, during a period t2 to t3, the second emission signal E(i−1)s' becomes the turn-off level, the sixth transistor M6 is turned off. Therefore, emission of the organic light emitting diode OLED is stopped, and charges stored in the organic light emitting diode OLED are initialized.

Next, during a period t4 to t5, the second scan signal S(i−1)s' becomes the turn-on level, and hence the fourth transistor M4 is turned on. The source electrode of the first transistor M1 is connected to the first power voltage line ELVDD through the fifth transistor M5, and the gate electrode of the first transistor M1 is connected to the first initialization voltage line VINT1 through the fourth transistor M4. Hence, the first transistor M1 is on-biased.

Next, during a period t5 to t6, the first emission signal Eis' becomes the turn-off level, and hence the fifth transistor M5 is turned off. During the period t5 to t6, charges stored in the storage capacitor Cst are initialized.

A driving method during a subsequent period refers to the description of FIG. 6. Also, an effect in the embodiment of FIG. 7 refers to the description of FIG. 6.

According to the exemplary embodiment, the pixel circuit PX1*j*_a and PX2*j*_a on the first and second rows, respectively, are operated in substantially the same way with the pixel circuits PXij_a except for the application of the second scan signal S(i−1)s' and the third scan signal S(i−2)s'; i.e. an $m^{th}$ scan signal Sms' and an $(m-1)^{th}$ scan signal S(m−1)s' of the previous frame directly preceding the current frame may be applied in place of the second scan signal S(i−1)s' and the third scan signal S(i−2)s'.

Figure 8:
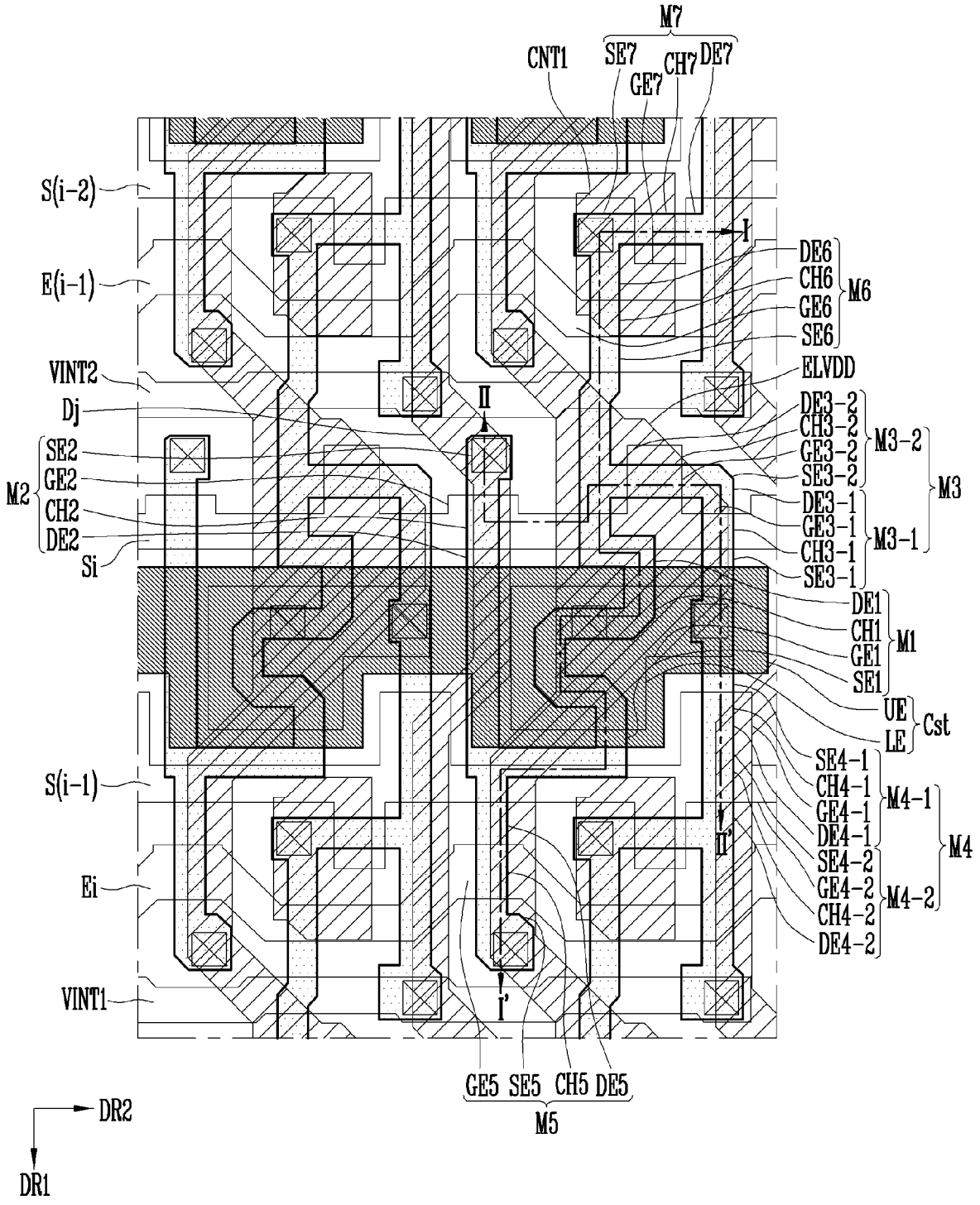
FIGS. 8, 9, and 10 are diagram illustrating an exemplary layout of a pixel circuit according to an exemplary embodiment.
Figure 9:
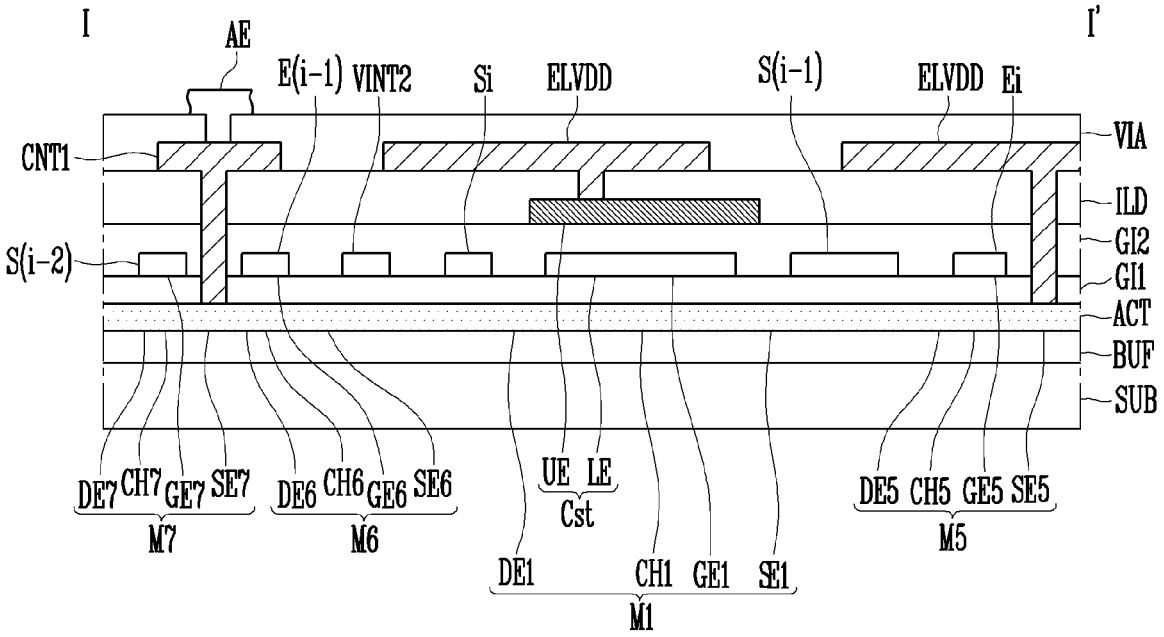
Figure 10:
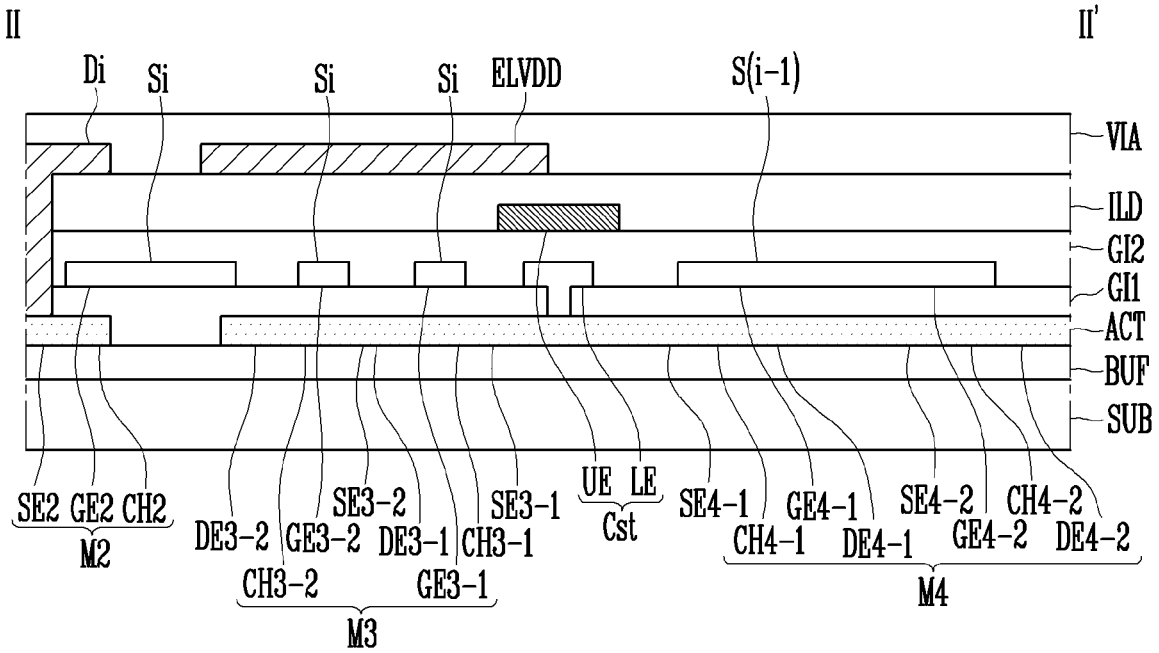

FIGS. 8, 9, and 10 are diagram illustrating an exemplary layout of a pixel circuit according to an exemplary embodiment.

FIG. 8 is an exemplary plan view of the pixel circuit PXij_a of FIG. 5, FIG. 9 is a sectional view taken along a sectional line I-I' of FIG. 8, and FIG. 10 is a sectional view taken along a sectional line II-II' of FIG. 8.

A substrate SUB is a rigid substrate or flexible substrate.

The rigid substrate may include a glass substrate, a quartz substrate, a glass ceramic substrate, and a crystalline glass substrate.

The flexible substrate may include a film substrate and a plastic substrate, which include a polymer organic material. For example, the flexible substrate may include one of polyethersulfone (PES), polyacrylate (PA), polyetherimide (PEI), polyethylene naphthalate (PEN), polyethylene terephthalate (PET), polyphenylene sulfide (PPS), polyarylate (PAR), polyimide (PI), polycarbonate (PC), triacetate cellulose (TAC), and cellulose acetate propionate (CAP). Also, the flexible substrate may include a fiber glass reinforced plastic (FRP).

A buffer layer BUF may cover the substrate SUB. The buffer layer BUF may prevent or limit impurities from being diffused into an active layer ACT from the substrate SUB. The buffer layer BUF may be an inorganic insulating layer. For example, the buffer layer BUF may be formed of silicon nitride (SiNx), silicon oxide (SiOx), silicon oxynitride (SiOxNy), or any combination thereof. The buffer layer BUF may be omitted according to the material and process conditions of the substrate SUB.

The active layer ACT may cover the buffer layer BUF. The active layer ACT may be formed of a semiconductor material. For example, the active layer ACT may be made of poly-silicon, amorphous silicon, oxide semiconductor, etc. A portion of the active layer ACT, which is undoped with an impurity, may constitute channels CH1 to CH7 of first to seventh transistors M1, M2, M3, M4, M5, M6, and M7, and a portion of the active layer ACT, which is doped with the impurity, may constitute electrodes SE1, SE2, SE3, SE4, SE5, SE6, and SE7 and DE1, DE2, DE3, DE4, DE5, DE6, and DE7 or lines. The impurity may be a p-type impurity. In some embodiments, the impurity may be at least one of a p-type impurity, an n-type impurity, and other metals.

A first gate insulating layer GI1 may cover the substrate SUB and the active layer ACT. The first gate insulating layer GI1 may cover source electrodes SE1, SE2, SE3, SE4, SE5, SE6, and SE7, drain electrodes DE1, DE2, DE3, DE4, DE5, DE6, and DE7, and the channels CH1 to CH7 of the first to seventh transistors M1, M2, M3, M4, M5, M6, and M7. The first gate insulating layer GI1 may be an inorganic insulating layer. For example, the first gate insulating layer GI1 may be formed of silicon nitride (SiNx), silicon oxide (SiOx), silicon oxynitride (SiOxNy), or any combination thereof.

Gate electrodes GE1, GE2, GE3, GE4, GE5, GE6, and GE7 of the first to seventh transistors M1, M2, M3, M4, M5, M6, and M7, first to third scan lines Si, S(i−1), and S(i−2), first and second emission lines Ei and E(i−1), first and second initialization voltage lines VINT1 and VINT2, and one electrode LE of a storage capacitor Cst may be located on the first gate insulating layer GI1. The electrodes and the lines on the first gate insulating layer GI1 may be made of the same conductive material. The electrodes and the lines on the first gate insulating layer GI1 may be made of molybdenum (Mo), titanium (Ti), aluminum (Al), silver (Ag), gold (Au), copper (Cu), or any combination thereof.

A second gate insulating layer GI2 may cover the first gate insulating layer GI1, the gate electrodes GE1, GE2, GE3, GE4, GE5, GE6, and GE7 of the first to seventh transistors M1, M2, M3, M4, M5, M6, and M7, the first to third scan lines Si, S(i−1), and S(i−2), the first and second emission lines Ei and E(i−1), the first and second initialization voltage lines VINT1 and VINT2, and the one electrode LE of the storage capacitor Cst. The second gate insulating layer GI2 may be an inorganic insulating layer. For example, the second gate insulating layer GI2 may be formed of silicon nitride (SiNx), silicon oxide (SiOx), silicon oxynitride (SiOxNy), or any combination thereof.

The other electrode UE of the storage capacitor Cst may be located on the second gate insulating layer GI2. For example, the other electrode of the storage capacitor Cst may be made of molybdenum (Mo), titanium (Ti), aluminum (Al), silver (Ag), gold (Au), copper (Cu), or any combination thereof.

An interlayer insulating layer ILD may cover the second gate insulating layer GI2 and the other electrode UE of the storage capacitor Cst. The interlayer insulating layer ILD may be an inorganic insulating layer. For example, the interlayer insulating layer ILD may be formed of silicon nitride (SiNx), silicon oxide (SiOx), silicon oxynitride (SiOxNy), or any combination thereof.

A first contact electrode CNT1 may be located on the interlayer insulating layer ILD, and be connected to a source electrode SE7 of a seventh transistor M7. A data line Dj and a first power voltage line ELVDD may be located on the interlayer insulating layer ILD. The electrodes and the lines on the interlayer insulating layer ILD may be made of the same conductive material. For example, the electrodes and the lines on the interlayer insulating layer ILD may be made of molybdenum (Mo), titanium (Ti), aluminum (Al), silver (Ag), gold (Au), copper (Cu), or any combination thereof.

A via layer VIA may cover the interlayer insulating layer ILD, the first contact electrode CNT1, the data line Dj, and the first power voltage line ELVDD. The via layer VIA may be an organic insulating layer. For example, the via layer VIA may include at least one of polystyrene, polymethylmethacrylate (PMMA), polyacrylonitrile (PAN), polyamide (PA), polyimide (PI), polyarylether (PAE), heterocyclic polymer, parylene, epoxy, benzocyclobutene (BCB), siloxane based resin, and silane based resin. In another exemplary embodiment, the via layer VIA may be an inorganic insulating layer, and have a multi-layered structure in which organic and inorganic insulating layers are repeatedly stacked.

An anode electrode AE of an organic light emitting diode OLED may be located on the via layer VIA. The anode electrode AE may be connected to the source electrode SE7 of the seventh transistor M7 through the first contact electrode CNT1. For example, the anode electrode AE may have a structure in which silver (Ag) and Indium Tin Oxide (ITO) are stacked.

An emission region defining layer defining an emission region, an emitting layer of the organic light emitting diode, which covers an opening of the emission region defining layer, and a cathode electrode covering the emission region defining layer and the emitting layer may be formed on the anode electrode AE. The emission region of the organic light emitting diode OLED may be properly selected according to a product having an RGB-stripe structure, a pentile structure, etc., and therefore, its illustration will be omitted in this embodiment.

The third scan line S(i−2), the second emission line E(i−1), the second initialization voltage line VINT2, the first scan line Si, the second scan line S(i−1), the first emission line Ei, and the first initialization voltage line VINT1 may be sequentially located on the same layer in a first direction DR1. The third scan line S(i−2), the second emission line E(i−1), the second initialization voltage line VINT2, the first scan line Si, the second scan line S(i−1), the first emission line Ei, and the first initialization voltage line VINT1 may extend approximately in a second direction DR2.

The second initialization voltage line VINT2 may vertically overlap with a point at which a source electrode SE6 of a sixth transistor M6 and a drain electrode DE1 of a first transistor M1 are in contact with each other. In other words, the second initialization voltage line VINT2 may vertically overlap with a point at which the source electrode SE6 of the sixth transistor M6 and a drain electrode DE3-2 of a third transistor M3 are in contact with each other. Also, the second initialization voltage line VINT2 may be connected to a drain electrode of a fourth transistor of a previous stage pixel circuit. The previous stage pixel circuit means a most adjacent pixel circuit located in a direction opposite to the first direction DR1. In addition, the third scan line S(i−2) may be connected to a gate electrode of the fourth transistor of the previous stage pixel circuit.

The first initialization voltage line VINT1 may be connected to a drain electrode of a seventh transistor of a next stage pixel circuit. The next stage pixel circuit means a most adjacent pixel circuit located in the first direction DR1.

The third transistor M3 may include sub-transistors M3-1 and M3-2 connected in series. The sub-transistor M3-1 may include a drain electrode DE3-1, a source electrode SE3-1, a gate electrode GE3-1, and a channel CH3-1. The sub-transistor M3-2 may include a drain electrode DE3-2, a source electrode SE3-2, a gate electrode GE3-2, and a channel CH3-2.

A fourth transistor M4 may include sub-transistors M4-1 and M4-2 connected in series. The sub-transistor M4-1 may include a drain electrode DE4-1, a source electrode SE4-1, a gate electrode GE4-1, and a channel CH4-1. The sub-transistor M4-2 may include a drain electrode DE4-2, a source electrode SE4-2, a gate electrode GE4-2, and a channel CH4-2.

Referring to the layout of FIG. 10, the pixel circuit PXij_a can be configured without adding a separate conductive layer or insulating layer, as compared with the related art.

Figure 11:
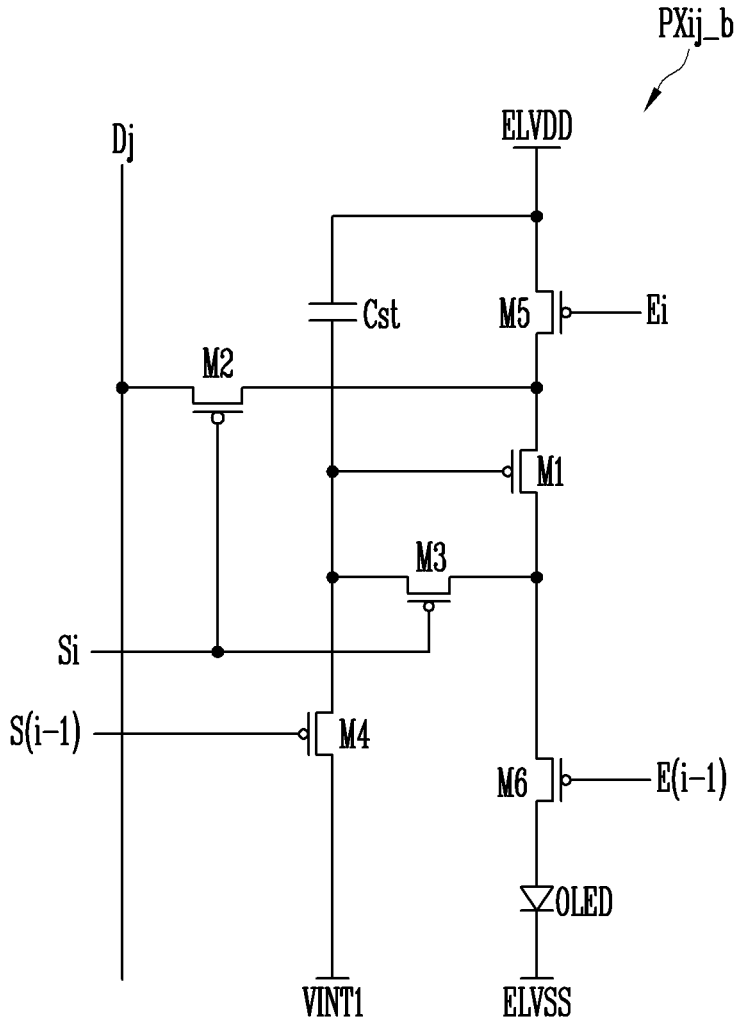
FIG. 11 is a diagram illustrating a pixel circuit according to another exemplary embodiment.

FIG. 11 is a diagram illustrating a pixel circuit according to another exemplary embodiment.

As compared with the pixel circuit PXij_a of FIG. 5, the seventh transistor M7 is omitted in the pixel circuit PXij_b of FIG. 11.

When the driving methods of FIGS. 6 and 7 are applied to the pixel circuit PXij_b, the current path connecting the first power voltage line ELVDD, the transistors M5, M1, M6, and M7, and the second initialization voltage line VINT2, which is shown in FIG. 5, is not formed even when the transistors M5 and M6 are turned on. Thus, current consumption can be reduced.

According to the present disclosure, the pixel circuit can prevent or reduce occurrence of unintended emission and over-current and reduce power consumption by allowing a driving transistor to be on-biased.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A pixel circuit comprising:

an organic light emitting diode;

a first transistor including a source electrode, a drain electrode, and a gate electrode;

a second transistor having a source electrode connected to a data line, a drain electrode connected to the source electrode of the first transistor, and a gate electrode connected to a first scan line;

a third transistor having a source electrode connected to the drain electrode of the first transistor, a drain electrode connected to the gate electrode of the first transistor, and a gate electrode connected to the first scan line;

a fourth transistor having a source electrode connected to the gate electrode of the first transistor, a drain electrode connected to a first initialization voltage line, and a gate electrode connected to a second scan line;

a fifth transistor having a source electrode connected to a first power voltage line, a drain electrode connected to the source electrode of the first transistor, and a gate electrode connected to a first emission line;

a sixth transistor having a source electrode connected to the drain electrode of the first transistor, a drain electrode connected to an anode electrode of the organic light emitting diode, and a gate electrode connected to a second emission line;

a seventh transistor having a source electrode connected to the anode electrode of the organic light emitting diode, a drain electrode connected to a second initialization voltage line, and a gate electrode connected to a third scan line; and a storage capacitor having a first electrode connected to the gate electrode of the first transistor and a second electrode connected to the first power voltage line, wherein:

the first emission line and the second emission line are located at different nodes;

the first emission line and the second emission line are configured to transmit a first emission signal and a second emission signal, respectively;

the first emission signal has a phase delayed compared with that of the second emission signal such that, for a single frame, a first pulse of the first emission signal is generated after a second pulse of the second emission signal is generated, and the first pulse is ended after the second pulse is ended; and a turn-on level pulse of a third scan signal is applied to the third scan line before a turn-off level pulse of the second emission signal is applied to the second emission line during the single frame.

2. The pixel circuit of claim 1, wherein the first scan line and the second scan line are located at different nodes.

3. The pixel circuit of claim 2, wherein the first scan line and the second scan line are configured to transmit a first scan signal and a second scan signal, respectively, and wherein the first scan signal has a phase delayed compared with that of the second scan signal.

4. The pixel circuit of claim 3, wherein a turn-on level pulse of the first scan signal temporarily overlaps with a turn-off level pulse of the first emission signal.

5. The pixel circuit of claim 4, wherein a turn-on level pulse of the second scan signal temporarily overlaps with a turn-off level pulse of the second emission signal.

6. The pixel circuit of claim 5, wherein the turn-on level pulse of the second scan signal is generated when the first emission signal is a turn-on level.

7. The pixel circuit of claim 5, wherein the turn-on level pulse of the second scan signal partially overlaps with a transition time of the turn-off level pulse of the first emission signal.

8. The pixel circuit of claim 1, wherein the turn-on level pulse of the third scan signal applied to the third scan line temporarily overlaps with a rising transition time of the turn-off level pulse of the second emission signal applied to the second emission line.

9. The pixel circuit of claim 1, further comprising a first gate insulating layer covering the source electrodes, the drain electrodes, and channels of the first to seventh transistors, wherein the gate electrodes of the first to seventh transistors, the first to third scan lines, the first and second emission lines, the first initialization voltage line and the second initialization voltage line, and the first electrode of the storage capacitor are located on the first gate insulating layer.

10. The pixel circuit of claim 9, further comprising a second gate insulating layer covering the first gate insulating layer, the gate electrodes of the first to seventh transistors, the first to third scan lines, the first and second emission lines, the first initialization voltage line and the second initialization voltage line, and the first electrode of the storage capacitor, wherein the second electrode of the storage capacitor is located on the second gate insulating layer.

11. The pixel circuit of claim 10, further comprising:

an interlayer insulating layer covering the second gate insulating layer and the second electrode of the storage capacitor; and a first contact electrode located on the interlayer insulating layer, the first contact electrode being connected to the source electrode of the seventh transistor, wherein the data line and the first power voltage line are located on the interlayer insulating layer.

12. The pixel circuit of claim 11, further comprising a via layer covering the interlayer insulating layer, the first contact electrode, the data line, and the first power voltage line, wherein the anode electrode of the organic light emitting diode is located on the via layer, and is connected to the source electrode of the seventh transistor through the first contact electrode.

13. The pixel circuit of claim 12, wherein the third scan line, the second emission line, the second initialization voltage line, the first scan line, the second scan line, the first emission line, and the first initialization voltage line are sequentially located on the same layer in a first direction.

14. The pixel circuit of claim 13, wherein the second initialization voltage line vertically overlaps with a point at which the source electrode of the sixth transistor and the drain electrode of the first transistor are in contact with each other.

15. The pixel circuit of claim 14, wherein the second initialization voltage line vertically overlaps with a point at which the source electrode of the sixth transistor and the drain electrode of the third transistor are in contact with each other.

16. The pixel circuit of claim 15, wherein the second initialization voltage line is connected to a drain electrode of a fourth transistor of a previous stage pixel circuit.

17. The pixel circuit of claim 16, wherein the third scan line is connected to a gate electrode of the fourth transistor of the previous stage pixel circuit.

18. The pixel circuit of claim 17, wherein the first initialization voltage line is connected to a drain electrode of a seventh transistor of a next stage pixel circuit.

* * * * *